US007804180B2

(12) United States Patent
Labbe et al.

(10) Patent No.: US 7,804,180 B2
(45) Date of Patent: Sep. 28, 2010

(54) DEVICE FOR CONTROLLING A HEAT ENGINE STARTER, SUCH AS THAT OF A MOTOR VEHICLE, AND STARTER COMPRISING ONE SUCH DEVICE

(75) Inventors: Nicolas Labbe, Lyons (FR); Christian Mornieux, Oullins (FR)

(73) Assignee: Valeo Equipements Electriques Moteur, Creteil Cedex (FR)

( * ) Notice: Subject to any disclaimer, the term of this patent is extended or adjusted under 35 U.S.C. 154(b) by 509 days.

(21) Appl. No.: 11/720,122

(22) PCT Filed: Jan. 31, 2006

(86) PCT No.: PCT/FR2006/000210

§ 371 (c)(1),
(2), (4) Date: Nov. 20, 2007

(87) PCT Pub. No.: WO2006/082306

PCT Pub. Date: Aug. 10, 2006

(65) Prior Publication Data

US 2008/0211235 A1 Sep. 4, 2008

(30) Foreign Application Priority Data

Feb. 2, 2005 (FR) ..... 05 01055

(51) Int. Cl.
*F02N 11/00* (2006.01)

(52) U.S. Cl. ..... 290/38 R; 290/34; 74/7 R

(58) Field of Classification Search ..... 290/30 R, 290/34, 38 R, 48; 74/6, 7 R
See application file for complete search history.

(56) References Cited

U.S. PATENT DOCUMENTS

| | | | | |
|---|---|---|---|---|
| 5,159,908 | A * | 11/1992 | Eyermann et al. | 123/179.1 |
| 5,731,638 | A * | 3/1998 | Niimi | 290/38 R |
| 6,776,273 | B2 * | 8/2004 | Kajino et al. | 192/12 B |
| 6,894,402 | B2 * | 5/2005 | Dubus et al. | 290/40 C |
| 2004/0123587 | A1 | 7/2004 | Kamiya et al. | |

FOREIGN PATENT DOCUMENTS

| | | |
|---|---|---|
| DE | 15 105 A1 | 7/1971 |
| EP | 1 225 685 A2 | 7/2002 |
| FR | 2 803 633 | 7/2001 |
| JP | 2-204676 | 8/1990 |

* cited by examiner

*Primary Examiner*—Nicholas Ponomarenko
(74) *Attorney, Agent, or Firm*—Berenato & White, LLC

(57) ABSTRACT

The invention relates to a device for controlling a starter for a heat engine that is equipped with an electric motor having a field coil with several windings and an armature winding, both of which are mounted in series, comprising a power contact which is equipped with terminals, one of said terminals being connected to the positive terminal (+Bat) of a battery and the other terminal being connected to the field coil having several windings. The inventive device comprises first means which, in a first phase upon closure of the power contact, activate part of the windings of the field coil and second delayed-action means which, in a second phase during which the power contact is always closed, activate at least a large number of the windings of the coil. The invention is intended for the heat engine starter of a vehicle.

12 Claims, 3 Drawing Sheets

DEVICE FOR CONTROLLING A HEAT ENGINE STARTER, SUCH AS THAT OF A MOTOR VEHICLE, AND STARTER COMPRISING ONE SUCH DEVICE

TECHNICAL FIELD OF THE INVENTION

The invention relates to a device for controlling a thermal engine starter, in particular for a motor vehicle, comprising an electric motor provided with a field winding and an armature winding connected in series.

PRIOR ART

With reference to FIG. 1, a conventional starter 10 comprises a support 16, intended to be fixed to a fixed part of the motor vehicle and fixedly carrying on the one hand the casing 15 of an electric motor 11 and on the other hand the housing 33 of an electromagnetic contactor 32 extending parallel to and radially above the electric motor 11 provided with a shaft 24.

The starter also comprises a starter head 30 provided with a freewheel device 52 acting between a pinion 50 and a driver 51, an output shaft 43 whose axis is merged with the axis 14 of the shaft 24, and a pivoting control lever 41 acting between a movable core 40 that the contactor 32 has and the driver 51 of the starter head 30.

In FIG. 1 the device 52 is a conventional freewheel device with cylindrical rollers subjected to the action of springs.

The contactor 32 also comprises a fixed core 35, a moving contact 129, a control rod 130 and at least one excitation coil B provided with at least one winding carried by the housing 33 by means of a support.

The housing 33 comprises a bottom through which the moving core 40 passes and is closed at the front by a cap 34 fixed by crimping to the free end of the housing 33 provided with a shoulder for the fixed core 35, which is axially wedged in the other direction by the cap 34 carrying electrical supply terminals 36, 37 conformed so as each to form a fixed contact 38 inside the cap 34 made from electrically insulating material.

The fixed core 35 comprises a central bore through which there passes the rod 130 intended to act on the moving contact 129.

The electric motor 11 is intended to drive in rotation the output shaft 43 coupled to the starter head 30 mounted for axial sliding on the output shaft between a rear idle position and a front position of meshing of the pinion 50 of the starter head 30 with a toothed starting ring 110 on the flywheel of the thermal engine, also referred to as the thermal combustion engine.

As can be seen in FIG. 1, the support 16 has an opening for the ring 110 to pass. The shaft 43 carries a stop 53 for limiting the movement of the pinion 50.

The electric motor 11 is provided with a field winding stator 12 and an armature rotor 13 mounted coaxially, the stator 12 surrounding the rotor 13, which is fixed to the shaft 24 mounted so as to rotate inside the casing 15 closed at the rear by a rear bearing 28 having a housing for the mounting here of a needle bearing 29 serving for the rotational mounting of the rear end of the shaft 24 of the motor 11. The rear bearing 28 serves as a centring device for the rear end of the casing 15 interposed between the support 16 of the starter and the bearing 28. This bearing 28 is connected by tie rods 31 to the support 16.

Here the front end of the output shaft 43 is mounted in a front bearing 42 of the support 16 consisting by way of example of a needle bearing, while the rear end of the output shaft 43 has, as described in the document FR-A-2787833, a recess for the arrangement of a plain bearing 44 serving for the rotational mounting of the front end of the shaft 24 of the electric motor 11 configured so as to form a sun gear 49 belonging to an epicyclic train constituting a speed reducer 45 with gears, which is interposed between the output shaft 43 and the shaft 24 of the electric motor 11.

The speed reducer 45 comprises a cylindrical ring 46 immobilised rotationally and having an internally toothed annular skirt. The teeth 48 on the ring 46 have an axial orientation and mesh with planet gears 47 mounted for rotation about axes carried by a transverse plate fixed to the rear end of the shaft 43 of the starter head 30. The ring 46 is a moulded piece, preferably made from rigid thermoplastic material.

The control lever 41 is coupled by its top end to the moving core 40 by means of a rod and a spring 131, referred to as a tooth against tooth spring, housed in the moving core 40. This lever comprises in its middle part a pivot axis 54, able to be integrated in an extension of the ring 46 of the reducer 45. The extension of the ring 46 consists of one or two flat tongues 55 each comprising a semi-cylindrical bearing 56 intended to receive the pivot axis 54. The space remaining between the rear of the tongues 55 and the support face 57 of the contactor 52 is occupied by a sealing stud 58 made from elastomer able to absorb the dimensional variations.

The lever 41 has a bottom end in the form of a fork mounted in a groove in the driver 51, provided internally with helical flutes in engagement in a complementary manner with external helical teeth carried by the output shaft 43. The starter head 30 is thus driven in a helical movement when it is moved by the lever 41 against the stop 53 in order, by means of its pinion 50, to come into engagement with the starting ring 110.

The stator 12 is fixed internally to the casing 15 and comprises here a field coil 17 comprising for example two pairs of windings 18, which are each wound around a pole shoe 19 fixed to the casing 15. The pole shoes 19 are fixed to the casing 15. The pole shoes 19 are fixed by means of screws 20 to the casing 15 as described in the document FR-A-2 611 096 (FIG. 1). Each winding 18 is composed of a continuous electrical conductor wound around the pole shoe 19 in the direction of its thickness so as to form concentric continuous turns of increasing diameter as is more clearly visible in FIGS. 2 to 5 of the document EP A 749 194. The axis of each winding 18 is radial with respect to the axis of the rotor 13 merged with the rotation axis 14 of the shaft 24.

In a variant the stator 13 comprises a body in the form of a packet of metal sheets provided with axial recesses or grooves distributed in a regular manner and intended to receive conductive electric wires belonging to a coil of the field winding as described for example in the document FR A 2 726 699.

The rotor 13 comprises a packet of metal sheets provided with axial recesses or grooves for mounting electrical conductors 21 in the form of wires or pins. These conductors 21 are connected together in order to form an armature winding connected to conductive blades 22 belonging to a collector 23 fixed to the shaft 24.

The armature winding 21 is connected in series with the field winding 17, in a known manner, by means of brushes 25.

These brushes 25 rub on the collecting blades 22 of the collector 23 in order to supply the armature rotor winding. The brushes 25, radially oriented, belong to a brush holder 26 equipped with cages for guiding and receiving the brushes, which are urged in the direction of the collecting blades 22 by springs 27. The brush holder 26 is fixed to the rear bearing 28.

As indicated in the document EP B 0 749 194, the ends of the conductor of a winding 18 of the stator permit the electrical connection of this winding with another winding, with a brush 25 or with a cable 39 acting between the contactor 32 and the electric motor 11.

Four brushes 25 are for example provided, distributed circumferentially in a regular manner, namely two brushes of positive polarity and two brushes of negative polarity.

More precisely, one of the terminals 36 of the contactor 32 is intended to be connected to the positive terminal of the battery of the motor vehicle, the other 37 is connected by means of a cable 39 to the input of the field winding 17 of the stator and to the brushes 25 of positive polarities. When the coil B is excited, the moving core 40 is drawn by magnetic attraction in the direction of the fixed core 35 in order to cause simultaneously the movement of the control rod 130 and the actuation of the control lever 41 of the starter head 30 in order to control the movement of the latter between its rear idle position (FIG. 1) and its front position of meshing with a toothed starting ring 110 rotationally connected, possibly elastically, with the flywheel of the thermal engine of the motor vehicle, consisting for example of a private car, a heavy goods vehicle or a boat with a thermal engine. In a variant the thermal engine is fixed.

When it is moved, the core 40, after the taking up of an axial clearance, acts on the control rod 130 guided by the central hole in the fixed core 35. This rod 130 carries the moving contact 129 and forms with it a moving device with the intervention of springs, not referenced with the exception of the spring 131, in order in particular to define an idle position of the moving contact 129 against the fixed core 35 and to return the moving core 40 into the idle position.

As is known the tooth against tooth spring 131 enables the movement of the moving core 40 and of the control rod to be continued when the teeth of the pinion 50 abut against the teeth of the set of teeth on the starting ring 110 before the electrical motor 11 is started up.

For more information reference should be made for example to the document FR A 2697370.

When the moving contact 129 comes into contact with the fixed contacts 38 of the contactor 32 (contacts 38 closed) the electric motor 11 is supplied electrically via the terminals 36, 37 so that the shaft 24 turns and drives the output shaft 43.

The contacts 38, 129 therefore belong to a control device for a thermal engine starter. These contacts belong to a power contact connected to the positive terminal of a battery, the closure of which permits the electrical supply to the electric motor 11 with a field winding 17 and armature winding 21 connected in series.

The electric current that passes through the excitation coil B of the contactor 32, when it is controlled by a starting switch connected to the battery, is approximately 80 to 100 A, while the electric current can reach 1000 A in the electric motor 11 when the contacts 38 are closed by the moving contact 129, the electrical diagram of the contactor being visible for example in FIG. 1 of the document FR A 2 679 717 to which reference should be made, the coil B being able to comprise an attraction and holding winding or a single winding, as respectively in FIG. 3 and FIG. 4 of this document.

Thus a current peak occurs when the fixed contacts 38 are closed by the moving contact 129, along with a voltage drop in the battery.

This current peak causes a torque peak at the pinion 50 and a risk of shaving the tooth starting wheel 110 when the pinion 50 is in contact with it.

In general terms this current and torque peak gives rise to a risk of degradation of the movement transmission device acting between the electric motor of the starter and the output shaft, such as the crankshaft of the thermal engine.

This current peak also gives rise to a current peak at the brushes 25, which is of such a nature as to reduce the service life of these.

In addition, there is a risk of accidental 'sticking' of the moving contact 129 to the fixed contacts 38.

OBJECT OF THE INVENTION

The object of the invention consists of producing a control device for a thermal engine starter that remedies the aforementioned drawbacks.

According to the invention a control device of the type indicated above is characterised in that it comprises first means for activating, in a first phase, when the power contact closes, part of the windings of the field coils and second deferred-action means that activating, in a second phase, during which the power contact is still closed, at least a large number of windings of the field coil.

A thermal engine starter is characterised in that it comprises a control device according to the invention.

By virtue of the invention, when the power contact closes, there are no excessive values of the maximum torque, nor short-circuit current, in the critical phase of passing the initial current peak.

Thus the electric motor turns initially at a slower speed since some of the windings of the field coil are activated.

Degradation of the movement transmission device acting between the electric motor of the starter and the output shaft, such as the crankshaft, of the thermal engine, is avoided.

The movement transmission device comprising a toothed starting ring, shaving of the starting ring by the pinion of the starter head is thus prevented.

Premature wear to the brushes is also prevented, as well as accidental sticking of the contacts.

The voltage drop in the battery is less so that resetting of the computers installed on board the vehicle is avoided, in particular resetting of the computer controlling the thermal engine.

The second means comprise, in one embodiment, a deferred-action switch that switches after a time delay.

The windings are in one embodiment connected in series with a resistor. The first means comprise in this case a first switch connection in parallel with respect to the resistor, while a second deferred-action switch is associated with the second means and is connected in parallel with respect to some of the windings.

The first switch is coupled to the second switch so that it closes in a second phase, while the second switch opens in the second phase.

In another embodiment the windings are mounted in branches in parallel, the switch of the second means being mounted in one of the branches.

The service life of the starter is in general terms increased along with its reliability.

It becomes possible to use the starter to fulfil a stop-start function of the thermal engine.

The invention also applies to a solution in which the movement transmission device acting between the starter and the output shaft of the thermal engine comprises a device with belt and pulleys or a device with chain and sprocket wheels.

In this case, in one embodiment, a freewheel device is for example provided at the driving pulley or the driving sprocket wheel so that wear on the movement transmission device is minimised.

By virtue of the invention there is greater latitude with regard to the choice of the battery.

SUMMARY DESCRIPTION OF THE DRAWINGS

Other advantages and characteristics will emerge more clearly from the following description of an embodiment of the invention given by way of non-limiting example and shown in the accompanying drawings, in which.

DETAILED DESCRIPTION OF SEVERAL EMBODIMENTS

Figure 1:
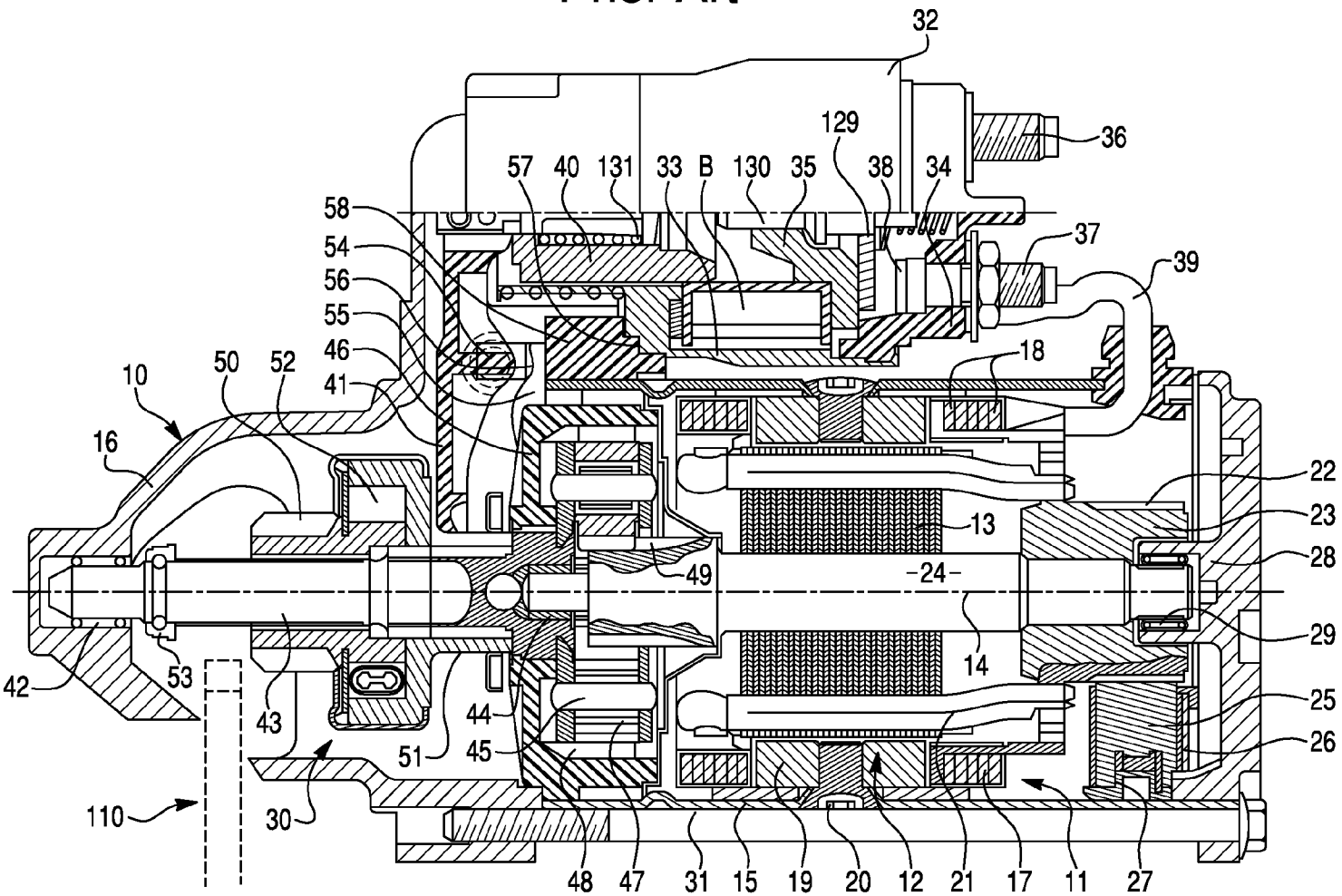
Fig. 1 Prior Art
FIG. 1 is a view in axial section of a known starter according to the prior art.

In FIGS. 2 to 6 the elements common with or similar to those in FIG. 1 will be allocated the same reference numbers.

Figure 3:
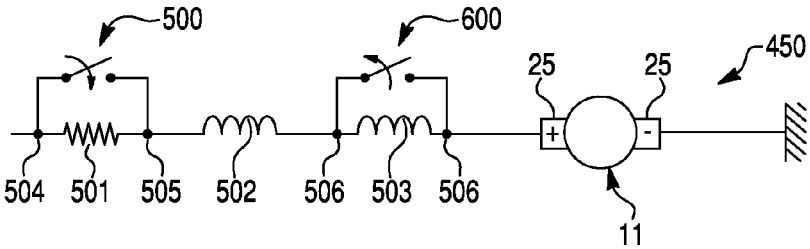
FIG. 3 depicts an electrical diagram of a device controlling a thermal engine starter for a first example embodiment of the invention.
Figure 5:
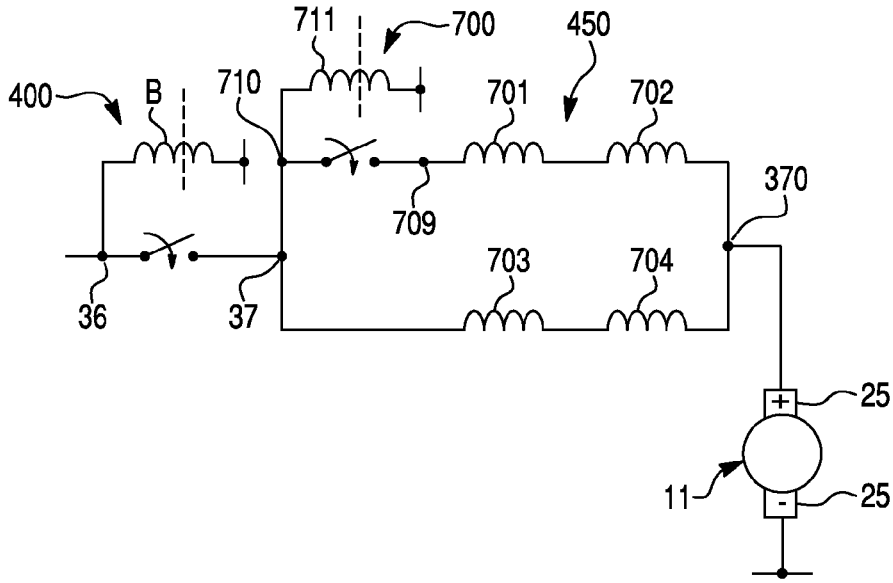
FIG. 5 is a view similar to FIG. 3 for a second example embodiment of the invention.

The control device for a starter for a thermal engine, in particular for a motor vehicle thermal engine, provided with an electric motor with a field coil and an armature coil connected in series via brushes shown symbolically in FIGS. 3 and 5, comprises as in FIG. 1 a power contact and at least one supplementary contact or switch with time-delayed control, that is to say deferred action.

This switch fulfils the role of auxiliary switch.

The power contact 400 is here of the type in FIG. 1 and therefore has recourse (FIG. 2) to an electromagnetic contactor 32 comprising an excitation coil B with one or two windings, activated by a starting switch 200 connected to the positive terminal (+Bat) of a battery. The closure of the staring switch 200, closed for example by an ignition key or by a starting card of the motor vehicle, allows the electrical supply to the excitation coil B and movement of the moving core actuating the control rod/moving contact device and the control lever.

When the moving contact 129 of the contactor is in contact with the fixed contacts of the terminals 36, 37, the power contact 400 is closed and the electric motor 11 is supplied electrically by its windings in series 17, 21 via the brushes 25 shown schematically in FIGS. 3 and 5.

Naturally the number of pairs of brushes depends on the application. For example 2, 4 or 6 brushes can be provided according to the size of the starter.

The invention is advantageous in the context of a starter comprising a starting device intended to stop the thermal engine of the vehicle when the latter is stopped, for example at a red light, and then to restart it, this function being called a stop-start function ('Stop-Start' in English).

Figure 2:
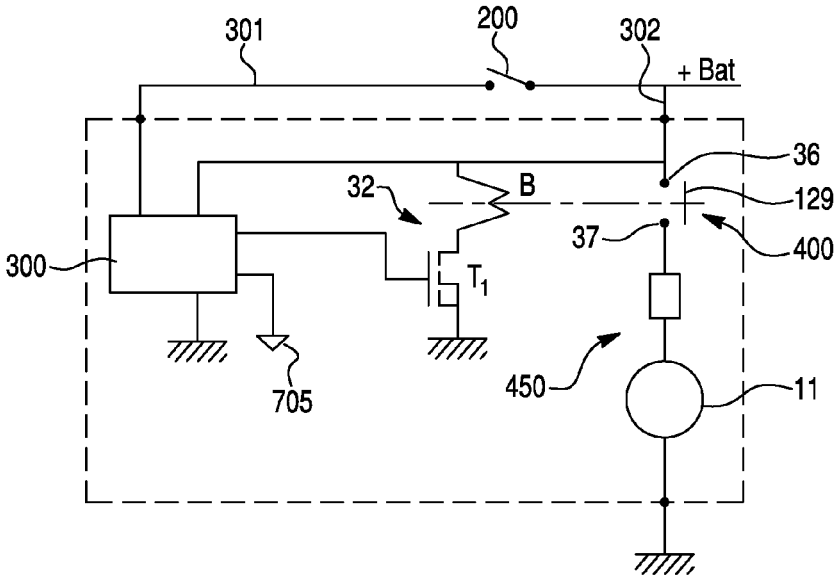
FIG. 2 is a view of an electrical diagram of a device controlling a thermal engine starter according to the invention.

In this case, as described for example in the document FR A 2 795 884, to which reference should be made, the excitation coil B is supplied in FIG. 2 by means of a pulse-mode transistor T1 of the pulse width modulation type, called 'PWM', the transistor T1 being controlled by a microcontroller 300 connected by an electrical connection 301, for example of the wire type, to the starting switch 200.

The power contact 400 is therefore controlled by the microcontroller 300, which according to one characteristic controls at least the aforementioned supplementary switch.

This is made possible by the fact that the control device according to the invention, described below, makes it possible to increase the service life of the starter.

Naturally the presence of the microcontroller is not essential.

In general terms the control device according to the invention makes it possible to greatly reduce the following drawbacks:

- shaving of the starting ring by the pinion of the starter head because of an excessively high torque peak when the power contact 400 closes.
- premature wear on the brushes through the establishment of repeated current peaks when the electric motor starts; accidental sticking of the contacts 38, 29 by accidental cutting off of these same current peaks.

By virtue of the invention a resetting of the computer controlling the engine of the motor vehicle is also prevented, such as the injection, ABS or any other computer, by generating an excessively low battery voltage due to the initial current peak when the power contact 400 closes, the battery voltage then dropping greatly.

By virtue of the invention the service life of the starter is increased along with its reliability, and this in a simple and economical manner.

More precisely the control device according to the invention marked 450 in FIG. 2 has recourse to two operating modes or phases with passage from one mode to another at the end of a short time delay.

In a first embodiment or operating phase, when the power contact 400 closes, some of the windings of the field coil 17 are involved.

In the second operating mode or phase, during which the power contact is still closed, after a short time delay, a larger number of or all the windings of the field coil 17 are involved.

This short time delay corresponds to a small time delay less than the time corresponding to the end of the sequence of driving the thermal engine by the electric motor of the starter.

In the first embodiment (FIG. 3) the control device 450 comprises two switches 500, 600, preferably of the electromagnetic type. These switches are coupled so that one closes while the other opens, and this with a time constant.

In the embodiment in FIG. 3, the electrical circuit of the control device for the electric motor 11, with a field coil and armature coil connected in series, comprises an additional resistor 501 in addition to the windings 502, 503 of the field coil.

The first switch 500 is connected in parallel with respect to the resistor 501 between the terminals 504, 505 thereof.

The second switch 600 is connected in parallel with respect to a second part 503 of the windings 502, 503 of the field coil between the terminals 506, 507 of this part 503.

The first part 502 of the windings of the field coil is mounted between the terminals 505 and 506, the two parts 502, 503 of the windings of the field coil being connected in series.

Thus, when the power contact 400 closes, the first switch 500 is open and the second switch 600 is closed.

In a first operating phase the electric current therefore passes through the resistor 501 and the first part 502 of the windings of the field coil since the second part 503 of these windings is short-circuited because the second switch 600 is closed.

There is therefore an increase in the resistance at the terminals of the electric motor 11 and a reduction in the inducing magnetic flux since the first part 502 of the windings is activated, that is to say in service while being supplied electrically.

This operating mode is therefore a defluxed and 'super-resistant' operating mode.

The maximum torque of the motor 11 is thus reduced. The same applies to the short-circuit current and the useful power.

The power contact 400 being still closed, in a second operating phase, at the end of a time delay, the second switch 600 opens and the first switch 500 closes so that the resistor 501 is short-circuited while the second part 503 of the windings of the field coil is activated.

There is therefore, during this second operating mode, a supply to a larger number of windings of the field coil or all the windings of the field coil with a reduction in the resistance at the terminals of the electric motor 11.

The second operating mode is a normal operating mode.

During this second mode or second phase an increase in the maximum torque of the electric motor occurs, as well as an increase in the short-circuit current and the useful power, and this between the end of the time delay and the end of the sequence of driving of the thermal engine by the starter.

Naturally it is clear from the above that the resistance 501 is preferably greater than the resistance of the second part 503 of the windings.

Figure 4:
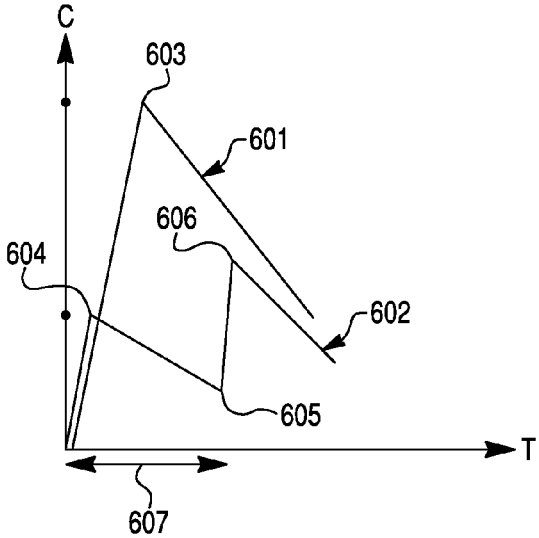
FIG. 4 is a diagram depicting the torque of the electric motor as a function of time.

FIG. 4 illustrates this. This figure shows on the y-axis the torque produced by the electric motor and on the x-axis the time.

The curve 601 is the curve of the prior art with at 603 a torque peak just after the closure of the power contact 400 in FIG. 2.

The curve 602 is the curve obtained by virtue of the invention with at 604 at torque peak just after the closure of the power contact 400 in FIG. 2 appreciably lower than the torque peak 603.

The torque of the curve 602 decreases to a value 605 and then increases up to the second value of 606 just after the end of the time delay 607, lying for example between 5 and 200 ms (milliseconds).

It should be noted that the torque 606 is higher than the torque 604.

Naturally this depends in particular on the time delay so that the torque 606 can be equal to or less than the torque 604.

It will be appreciated that the pinion of the starter head turns at a lower speed with respect to the starting ring (see reference 110 in FIG. 1) when it is not in engagement with the teeth on the set of teeth on the starting ring.

The risks of shaving are therefore greatly reduced.

At the end of the time delay the pinion is in engagement with the teeth on the starting ring in all cases.

In a variant the windings of the field coil are mounted in parallel, as can be seen in FIG. 5.

In this FIG. 5 the first switch is the power contact 400 of FIG. 2. The terminal 36 of this switch is connected to the positive terminal of the battery and the terminal 37 to two branches of windings of the field coil mounted in parallel.

The branches are mounted in parallel between the terminals 37 and 370 respectively of the power contact 400 and of the electric motor 11, or more precisely the brushes 25 thereof.

The two branches are therefore mounted in a series between the output terminal 37 of the power contact and the input terminal 370 of the armature of the electric motor 11.

The second branch comprises the second deferred-action switch 700, here of the electromagnetic type like the contact 400, connected in series with the windings 701, 702 of the field coil consisting of the first part of the windings.

The first branch comprises the second part of the windings of the field coil, namely the windings 703, 704.

The windings 701, 702 and 703, 704 are therefore mounted in parallel.

When the contact 400 closes, the switch 700 is open so that only the windings 703 and 704 are active.

At the end of the time delay the switch 700 closes so that all the windings are active.

According to one characteristic the control device is configured so that, when the power contact 400 opens, the switch 700 opens.

Figure 6:
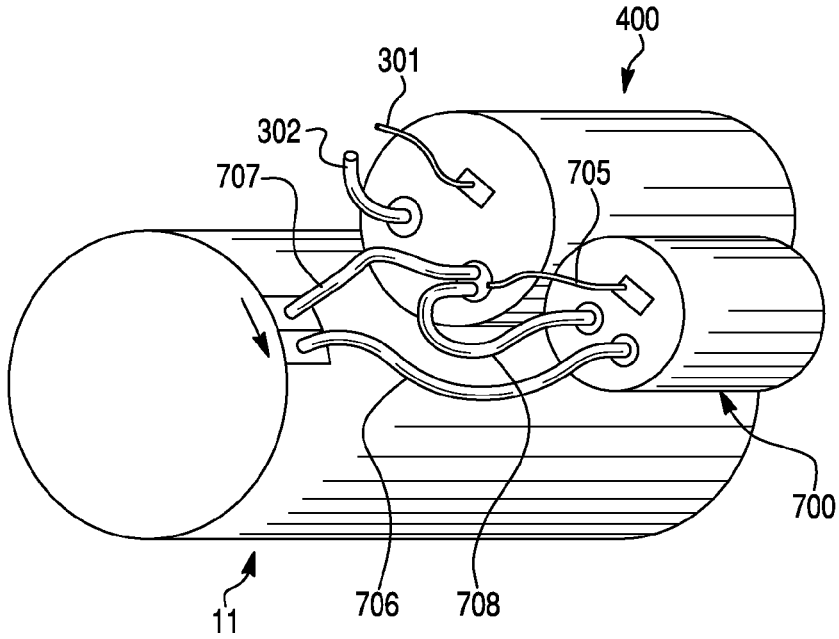
FIG. 6 is a schematic view of the electric motor equipped with two switches of the embodiment in FIG. 5.

FIG. 6 depicts the electrical connections, here of the wire type.

There can be seen at 302, 706, 707 and 708 high-power connections and at 301 and 705 connections of lower power, namely control connections. The connections 301 and 302 correspond to those in FIG. 2. The connections 707 and 706 connect respectively the terminal 37 of the power contact 400 to the windings 703, 704 and the output terminal 709 (FIG. 5) of the switch 700, constituting an auxiliary switch, to the windings 703, 704.

The connection 708 connects the output terminal 37 of the contact 400 to the input terminal 710 of the switch 700. The connection 708 is a control connection between the exciting coil B of the contact 400 and the exciting coil 711 of the switch 700.

As will have been understood the contact 400 and switch 700 are mounted outside the electric motor of the starter, the cable 39 being omitted. In a variant they are mounted in the electric motor and/or in the starter support.

The time delay is in one embodiment implemented by means of a time delay circuit using a resistor and a capacitor in addition to the excitation winding of the switch 600, 700 of the electromagnetic type.

Thus for example in FIG. 5 the closure of the switch 700 is time-delayed by a circuit with resistor and capacitor that is charged up to the conjunction voltage of the switch 700.

In a variant use can be made of a more complete electronic circuit, the capacitor charging by means of a resistor and the base of a transistor.

In a variant the time delay circuit belongs to the microcontroller 300 and it is for this reason that the connection 705 with the coil 711 of the switch 700 has been shown in FIG. 2.

As a result the switch 700 opens when the power contact 400 opens following the opening of the starting switch 200.

In a variant the time constant is defined by an external control device.

In a variant this time constant is defined by the switch 700 itself, that is to say by the springs and the resistance of the excitation coil of the electromechanical switch.

Likewise the microcontroller 300 can control the switches 500, 600 and therefore respectively the closing and opening of these after a time delay.

All combinations are possible.

It should be noted that the resistances of the windings are low, for example 4 milliohms for the part 703, 704 or 702, 701. The variation in resistance between the two operating phases is therefore 2 milliohms.

The variation in resistance is preferably chosen so as to be between 1 and 50 milliohms.

For example, in FIG. 3, 10 milliohms is chosen as the additional resistance for resistances of windings 502, 503 from 2 to 4 milliohms.

As is clear from the description and drawings the embodiment in FIG. 5 is advantageous compared with that in FIG. 3 since one switch and one additional resistor are saved on.

Naturally the present invention is not limited to the example embodiments described.

Thus it is possible, depending on the number of windings, to provide an additional deferred-action switch that opens after the second switch 600, 700.

In a first phase a first part of the windings is involved and then in a second phase a second part of the windings and finally, in a third phase, all the windings.

For example it is possible in FIG. 5 to provide a supplementary branch with one or more windings and the additional switch.

It should be noted that FIGS. 3 and 5 depict symbolically the brushes 25 of the electric motor 11 that rub against the collector of FIG. 1 electrically connected to the armature winding. These brushes connect the armature and field windings in series.

According to the invention the control device for a starter for a thermal engine, in particular for a motor vehicle thermal engine, provided with an electric motor 11 with a field winding 17 and an armature winding 21 connected in series, comprising a power contact 400 one of whose terminals 36 is connected to the positive terminal (+Bat) of a battery and whose other terminal 37 is connected to the field coil 17 with several windings 502, 503-701 to 704, is characterised in that it comprises first means 500, 501, 502-703, 704 for, in a first phase, when the power contact 400 is closed, activating some of the windings of the field coil 17 and second deferred-action means 600, 503-700, 701, 702 for activating in a second phase, during which the power contact is still closed, at least a larger number of windings of the field coil 17.

The windings of the field coil are supplied electrically when they are activated.

Naturally in a variant recourse can be had to the control device of the aforementioned document FR A 2 679 717 for controlling the power contact.

Naturally the starter can be of any type.

Thus is a variant the contactor 32 extends to the rear or front of the electric motor 11 in particular when it is wished to integrate the control device according to the invention in the electric motor and/or in the starter support.

In the case where the contactor is at the front of the electric motor, the starter head fulfils the role of the moving core and advantageously has a skirt with a cylindrical external surface defining an air gap with the support for the coil B.

The movement of the starter head is then controlled by a control means of the electromagnetic type, the material of the skirt and driver being chosen accordingly.

In a variant the movement of the control lever 41 is controlled by an electric motor, the contactor 32 then being simplified since it no longer has a moving core.

The shaft 24 is in a variant merged with the output shaft so that the presence of the reduction gear 45 is not obligatory.

This reduction gear can be configured so that the axes of the shafts 24 and 43 are offset radially.

The brushes 25 and collector 23 are in a variant axially oriented.

In a variant the pinion 50 is an emerging pinion arranged outside the support, as illustrated in the document FR-A-2745855.

In a variant the freewheel device 52 is equipped with a friction clutch described for example in the document FR-A-2772433 and FR-A-2826696.

In a variant the pinion of the starter head is intended to mesh with teeth belonging to a driven pulley of a movement transmission device with belt and pulleys driving and driven as described for example in the document FR 0350376 filed on 28 Jul. 2003, this type of starter being referred to as a belt starter.

Naturally the belt starter in a variant has no starter head, its output shaft being intended to drive the driven pulley, the freewheel then being integrated in the driving pulley, as described for example in the document JP A 2001-153010.

In a variant the belt starter can be mounted alongside the alternator, its output shaft being connected by gears to an intermediate shaft, itself connected to the driven pulley of the movement transmission device with pulleys and belt acting between the intermediate shaft and the output shaft, such as the crankshaft of the thermal engine. In this case the intermediate shaft is the shaft of the alternator connected disengageably to the gears, as described for example in the documents U.S. Pat. No. 6,378,479 and FR A 1 477 763.

The belt starter in all cases is adapted by means of its output shaft to drive, directly or indirectly, a movement transmission device with pulleys and belt acting in the movement transmission line between the output shaft of the starter and the output shaft, such as the crankshaft of the thermal engine.

In a variant the pulleys and belt are replaced by a chain and sprocket wheels.

All this is made possible since by virtue of the invention the wear on the movement transmission device is reduced.

The invention claimed is:

1. Device for controlling a starter for a thermal engine, provided with an electric motor (11) with a field coil (17), provided with several windings, and with an armature coil (21), mounted in series, comprising a power contact (400) provided with terminals (36, 37) one of which (36) is connected to the positive terminal (+Bat) of a battery and the other one (37) of which is connected to the field coil (17) with several windings (502, 503-701 to 704), characterised in that it comprises first means (500, 501, 502-703, 704) for, in a first phase, when the power contact (400) is closed, activating some of the windings of the field coil (17) and second deferred-action means (600, 503-700, 701, 702) for activating, in a second phase, during which the power contact (400) is still closed, at least a larger number of windings of the field coil (17).

2. Device according to claim 1, characterised in that the second deferred-action means are configured so as to activate, in a second phase, all the windings of the field coil (17).

3. Device according to claim 2, characterised in that it comprises at least one supplementary switch (600, 700) with time-delay control.

4. Device according to claim 1, characterised in that the second means comprise a deferred-action switch (600, 700) that switches after a time delay.

5. Device according to claim 1, characterised in that the windings of the field coil (17) are connected in series with a resistor (501).

6. Device according to claim 5, characterised in that the first means comprise a first switch (500) connected in parallel with respect to the resistor (501), while a deferred-action switch is associated with the second means and is connected in parallel with respect to part of the windings (503).

7. Device according to claim 6, characterised in that the first switch (500) closes during the first phase while the second switch (600) opens during the second phase.

8. Device according to claim 7, characterised in that the windings (701 to 704) of the field coil (17) are mounted in branches in parallel connected to the power contact (400).

9. Device according to claim 8, characterised in that a second deferred-action switch (700), belonging to the second means, is mounted in one of the branches in series with at least one winding of the field coil (17).

10. Device according to claim 8, characterised in that the second switch (700) is open when the power contact (400) is open.

11. Device according to claim 1, characterised in that the power contact (400) is controlled by a microcontroller, which, with a time delay, controls a switch belonging to the second means.

12. Device according to claim 1, characterised in that the second deferred-action means act after a time delay less than the time corresponding to the end of the sequence of driving of the thermal engine by the electric motor (11).

* * * * *